US012534245B1

(12) United States Patent
Wei

(10) Patent No.: US 12,534,245 B1
(45) Date of Patent: Jan. 27, 2026

(54) VACUUM PACKAGE MACHINE

(71) Applicant: Huizhou Ruigang Technology Co., Ltd., Guangdong (CN)

(72) Inventor: Weicheng Wei, Heyuan (CN)

( * ) Notice: Subject to any disclaimer, the term of this patent is extended or adjusted under 35 U.S.C. 154(b) by 0 days.

(21) Appl. No.: 18/931,704

(22) Filed: Oct. 30, 2024

(51) Int. Cl.
*B65B 31/04* (2006.01)
*B65B 51/10* (2006.01)

(52) U.S. Cl.
CPC ..... *B65B 31/048* (2013.01); *B65B 51/10* (2013.01)

(58) Field of Classification Search
CPC ... B65B 31/048; B65B 31/047; B65B 31/046; B65B 51/10
See application file for complete search history.

(56) References Cited

U.S. PATENT DOCUMENTS

2005/0050860 A1* 3/2005 Sung ..... B65B 31/046 53/512
2007/0199283 A1* 8/2007 Sung ..... B65B 31/046 53/512
2021/0347508 A1* 11/2021 Li ..... B65B 51/148
2022/0250779 A1* 8/2022 Li ..... B65B 51/10

FOREIGN PATENT DOCUMENTS

CN 216975151 U * 7/2022

OTHER PUBLICATIONS

Translation of CN 216975151 U (Year: 2022).*

* cited by examiner

*Primary Examiner* — Thomas M Wittenschlaeger
(74) *Attorney, Agent, or Firm* — Nicholas Makridakis

(57) ABSTRACT

The disclosure relates to the field of vacuum package and discloses a vacuum package machine, which includes a lower housing, an upper turning cover rotationally disposed on the lower housing and a clamping component disposed between the lower housing and the upper turning cover. The lower housing is internally provided with a vacuum cavity configured to store water discharged from a package bag during vacuum pumping, and a water level probe is disposed in the vacuum cavity. The clamping component is configured to clamp a bag opening of the package bag and cooperate with the vacuum cavity to form a sealed cavity for vacuum pumping.

9 Claims, 7 Drawing Sheets

VACUUM PACKAGE MACHINE

TECHNICAL FIELD

The disclosure relates to the technical field of vacuum package, and in particular, to a vacuum package machine.

BACKGROUND

A vacuum machine is also called as a vacuum preservation machine. When the vacuum machine is used, food packaged in a vacuum bag generally has much water which may be pumped into a vacuum cavity, and the vacuum cavity will be fully filled with water after pumping for several times. If the water is not poured away in time, the water will be pumped into a vacuum pump and a pressure switch to cause vacuum pumping abnormality. Therefore, most of the vacuum machines are provided with a water fullness alarm device to give an alarm at a certain water fullness degree and switch off the program in a forced manner, and the program will be normal after the water is poured away. According to a traditional vacuum machine water fullness detection method, light control and double-probe methods are used for detection, the structure is complicated, and the reliability is low.

Additionally, the heating speed of a heating wire of a sealing component of a traditional household vacuum machine is rapid, so that the heat may be accumulated onto the heating wire and cannot be dissipated quickly, the temperature is high, if the sealing for the next time is immediately followed, it is possible that a bag to be sealed may be stuck as soon as a cover is closed and cannot be vacuumed. Generally, a next sealing cycle may be performed after about half a minute, so that the efficiency is low.

When food is packaged in the vacuum bag, a bag opening of the package bag is expanded and cannot be flatly pressed during cover closing and pressing, so air leakage at the bag opening is caused, and vacuum pumping is failed. In order to flatly press the bag opening, the bag opening needs to be repeatedly flattened by two hands, so that the two hands have no time to press down a flip cover, and the bag opening may mess up after the hands leave away. When the flip cover is pressed by the right hand, the bag opening may deform and open if the left hand moves away from the bag opening, and the operation is very difficult. Even so, it is sometimes necessary to repeat the operation for two or three times to reach the success, and the noise generated by the vacuum pump is very loud during vacuum pumping.

SUMMARY

The disclosure aims to provide a vacuum package machine to solve the above problems. The detailed descriptions are provided below.

To achieve the above purpose, the disclosure provides the following technical solution:

A vacuum package machine provided by the disclosure includes:

a lower housing;

an upper turning cover, rotationally disposed on the lower housing, where the lower housing is internally provided with a vacuum cavity configured to store water discharged from a package bag during vacuum pumping, and the vacuum cavity is internally provided with a water level probe; and a clamping component, disposed between the lower housing and the upper turning cover and configured to tightly clamp a bag opening of the package bag and cooperate with the vacuum cavity to form a sealed cavity for vacuum pumping.

The clamping component includes a bag opening clamping plate, the bag opening clamping plate is rotationally disposed in the vacuum cavity, and is configured to cooperate with an inner wall of the vacuum cavity to tightly clamp the bag opening of the package bag.

A hot-melting sealing component is disposed on the upper turning cover, and is configured to melt the bag opening of the package bag and bond the bag opening position of the package bag to realize sealing.

A device installing plate is disposed in the upper turning cover; a cooling component for cooling the hot-melting sealing component and a vacuum pump are disposed on the device installing plate; an air pumping end of the vacuum pump communicates with the vacuum cavity through a first pipeline; and a breathable acoustic material is disposed inside the vacuum pump and is configured to absorb noise during air exhausting.

When the vacuum package machine is used, the upper turning cover is turned over, the package bag requiring vacuum pumping is disposed between the upper turning cover and the lower housing, the bag opening of the package bag extends into the vacuum cavity, then, the upper turning cover is closed, and the bag opening of the package bag is in the sealed cavity through the cooperation of the upper turning cover with the clamping component and the vacuum cavity. Then, through the vacuum pump, air in the sealed cavity is completely exhausted until the air in the package bag is completely pumped out. In this process, if there is water in the package bag, the water will be pumped out and flow into the vacuum cavity. The water level probe may give out a prompt when detecting the water fullness, so the contact of the water in the vacuum cavity with electronic elements of the vacuum package machine due to continuous use of the vacuum package machine after water fullness is avoided.

When the vacuum pump operates, noise may be significantly absorbed through a sponge block and the breathable acoustic material. After the vacuum pumping of the package bag is completed, the opening of the package bag is sealed through the hot-melting sealing component, and heat dissipation on the hot-melting sealing component may be realized through the cooling component, so that the hot-melting sealing component may continuously operate.

Preferably, the clamping component includes a rotating shaft and a sealing strip. The rotating shaft is rotationally disposed on the device installing plate in a length direction of the device installing plate. A clamp hook is fixed to each of two ends of the rotating shaft. Clamp grooves are formed in the lower housing. The clamp hook rotates with the rotating shaft and is able to be clamped in the corresponding clamp groove. A handle is disposed on the rotating shaft, and the handle passes through the upper turning cover. The sealing strip is disposed at an upper side of the vacuum cavity.

Preferably, an annular groove is formed in the upper side of the vacuum cavity, and a sealing ring is disposed in the annular groove. The sealing strip corresponds to a bottom of the hot-melting sealing component.

Preferably, the water level probe is installed on the device installing plate, and a probe of the water level probe passes through the device installing plate to enter the vacuum cavity.

Preferably, the hot-melting sealing component includes a heat conduction housing. The heat conduction housing is disposed on the device installing plate. A high-temperature adhesive tape is laid in the heat conduction housing, and an electric heating wire is disposed on the high-temperature adhesive tape. A bottom of the heat conduction housing corresponds to the sealing strip.

Preferably, the cooling component includes a blower. The blower is disposed on the device installing plate. A blowing end of the blower communicates with the heat conduction housing through a ventilation pipe. A mica plate is disposed on a top of the heat conduction housing, and through holes are formed in each of the mica plate and the heat conduction housing.

Preferably, a cutting component is disposed in the lower housing, and is configured to cut away excessive portions after sealing of the package bag.

Preferably, the cutting component includes a cutter holder. The cutter holder is disposed in the lower housing. A slide block is slidingly disposed in the cutter holder. A cutter blade is disposed on the slide block. A cutter cap is disposed on the cutter blade.

Preferably, the vacuum pump includes a host. An acoustic shield is installed on the host, and the breathable acoustic material is disposed in the acoustic shield. A first air outlet hole is formed in the host, and the acoustic shield is able to cover the first air outlet hole. A second air outlet hole is formed in the acoustic shield. The second air outlet hole is connected with a sponge block through a second pipeline, and an end portion of the second pipeline is disposed in the sponge block.

The beneficial effects are as follows:

1. Through the cooperation of the upper turning cover with the clamping component and the vacuum cavity, the bag opening of the package bag is in the sealed cavity, and a bag opening of a vacuum bag may be tightly clamped through the clamping component, and the bag opening may not mess up after two hands leave away, which is high in reliability and easy to operate.
2. Through the vacuum pump, the air in the sealed cavity is completely exhausted until the air in the package bag is completely pumped out. In this process, if there is water in the package bag, the water will be pumped out and flow into the vacuum cavity. The water level probe may give out a prompt when detecting the water fullness, so the device damage caused by contact of the water in the vacuum cavity with electronic elements of the vacuum package machine due to continuous use of the vacuum package machine after water fullness is avoided. Moreover, the water pumping and water fullness detection structures are simple, and are easy to manufacture, and the production costs are effectively controlled.
3. The noise generated when the vacuum pump operates may be significantly absorbed through the sponge block and the breathable acoustic material, and the influence on others due to too loud noise during device operation is avoided.
4. Through the cooling component, the heat dissipation on the hot-melting sealing component may be realized, so that the hot-melting sealing component may continuously operate, and the sealing efficiency and sealing quality are improved.
5. By turning over the bag opening clamping plate, the bag opening of the package bag may be clamped through cooperation of the bag opening clamping plate and the vacuum cavity, the bag opening may not mess up when both hands of a user leave the bag opening of the package bag, so that the vacuum pumping efficiency and effects of the vacuum bag are ensured, and at the same time, the operation of the vacuum package machine is convenient.

BRIEF DESCRIPTION OF FIGURES

To describe the technical solutions in examples of the disclosure or the prior art more clearly, the following briefly describes the accompanying drawings required for describing the examples or the prior art. Apparently, the accompanying drawings in the following description show only some examples of the disclosure, and a person of ordinary skill in the art may still derive other accompanying drawings from the accompanying drawings without creative efforts.

In the figures,

1 denotes lower housing, 2 denotes upper turning cover, 3 denotes clamping component, 4 denotes device installing plate, 5 denotes handle, 6 denotes rotating shaft, 7 denotes clamp hook, 8 denotes clamp groove, 9 denotes vacuum cavity, 10 denotes sealing strip, 11 denotes hot-melting sealing component, 12 denotes heat conduction housing, 13 denotes high-temperature adhesive tape, 14 denotes electric heating wire, 15 denotes mica plate, 16 denotes cooling component, 17 denotes blower, 18 denotes vacuum pump, 19 denotes water level probe, 20 denotes sponge block, 21 denotes host, 22 denotes first air outlet hole, 23 denotes breathable acoustic material, 24 denotes acoustic shield, 25 denotes second air outlet hole, 26 denotes cutting component, 27 denotes cutter holder, 28 denotes slide block, 29 denotes cutter blade, 30 denotes cutter cap, 31 denotes sealing ring, and 32 denotes bag opening clamping plate.

DETAILED DESCRIPTION

In order to make objectives, technical solutions and advantages of the disclosure clearer, the technical solution of the disclosure will be further described in detail below. Apparently, the described examples are merely a part of examples of the disclosure and are not all the examples. On the basis of the examples in the disclosure, all other implementations obtained by a person of ordinary skill in the art without creative efforts fall into the scope of protection of the disclosure.

Figure 1:
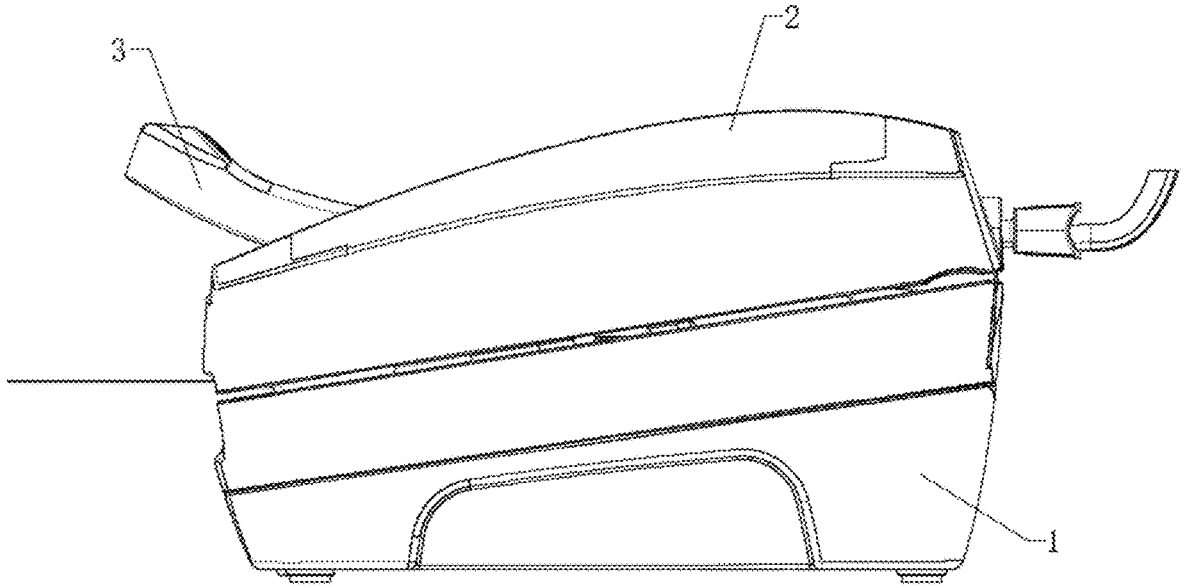
FIG. 1 is a front-view schematic structure diagram of the disclosure.
Figure 2:
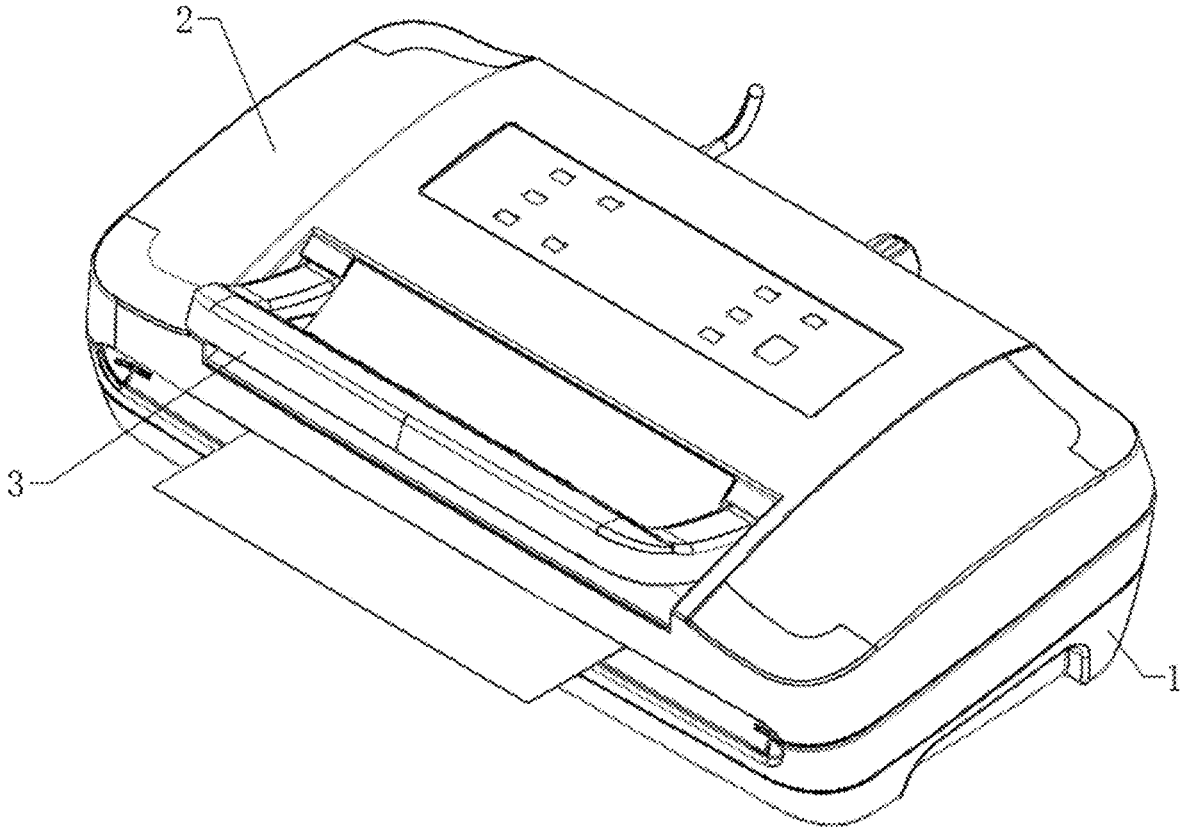
FIG. 2 is a schematic three-dimensional structure diagram of the disclosure.
Figure 3:
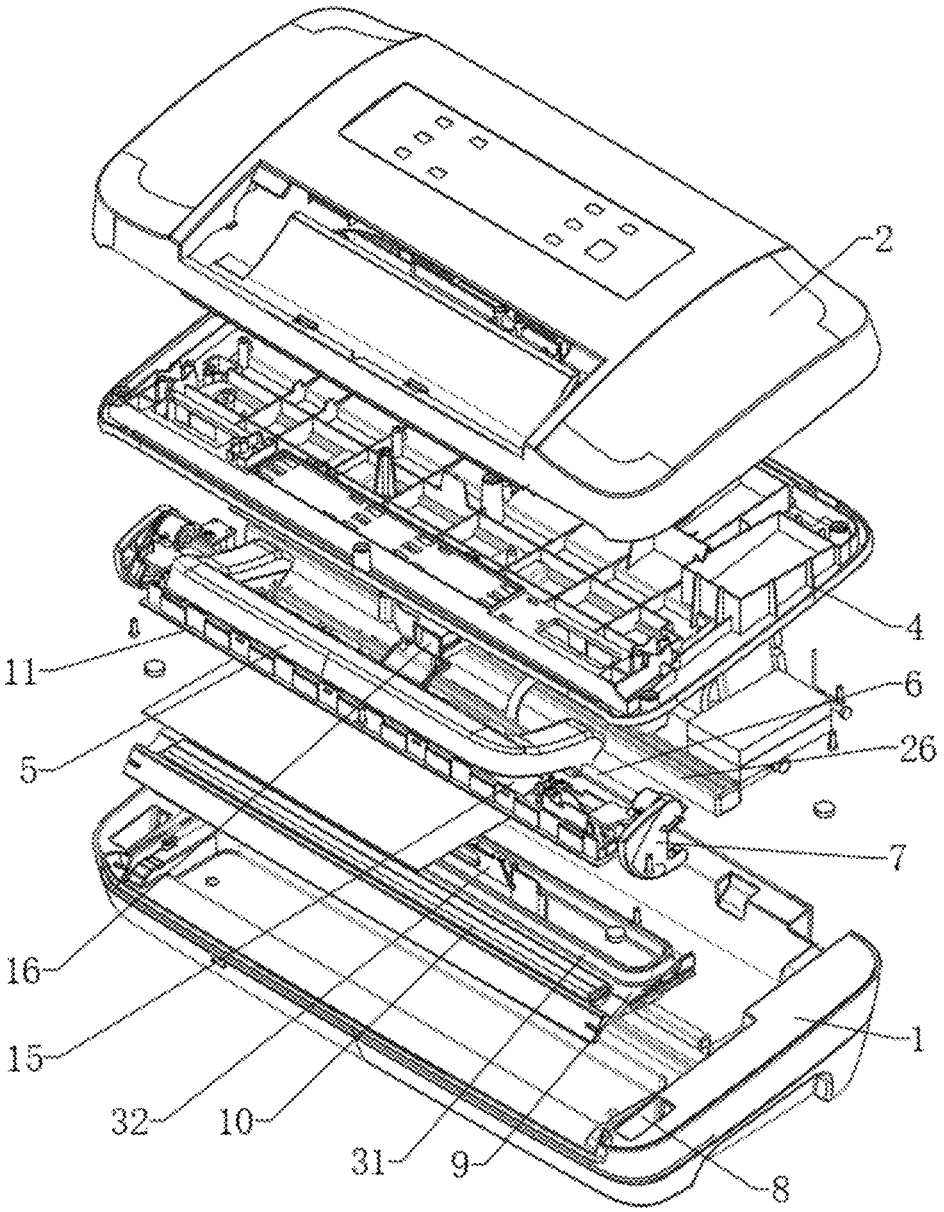
FIG. 3 is a schematic exploded structure diagram of the disclosure.
Figure 4:
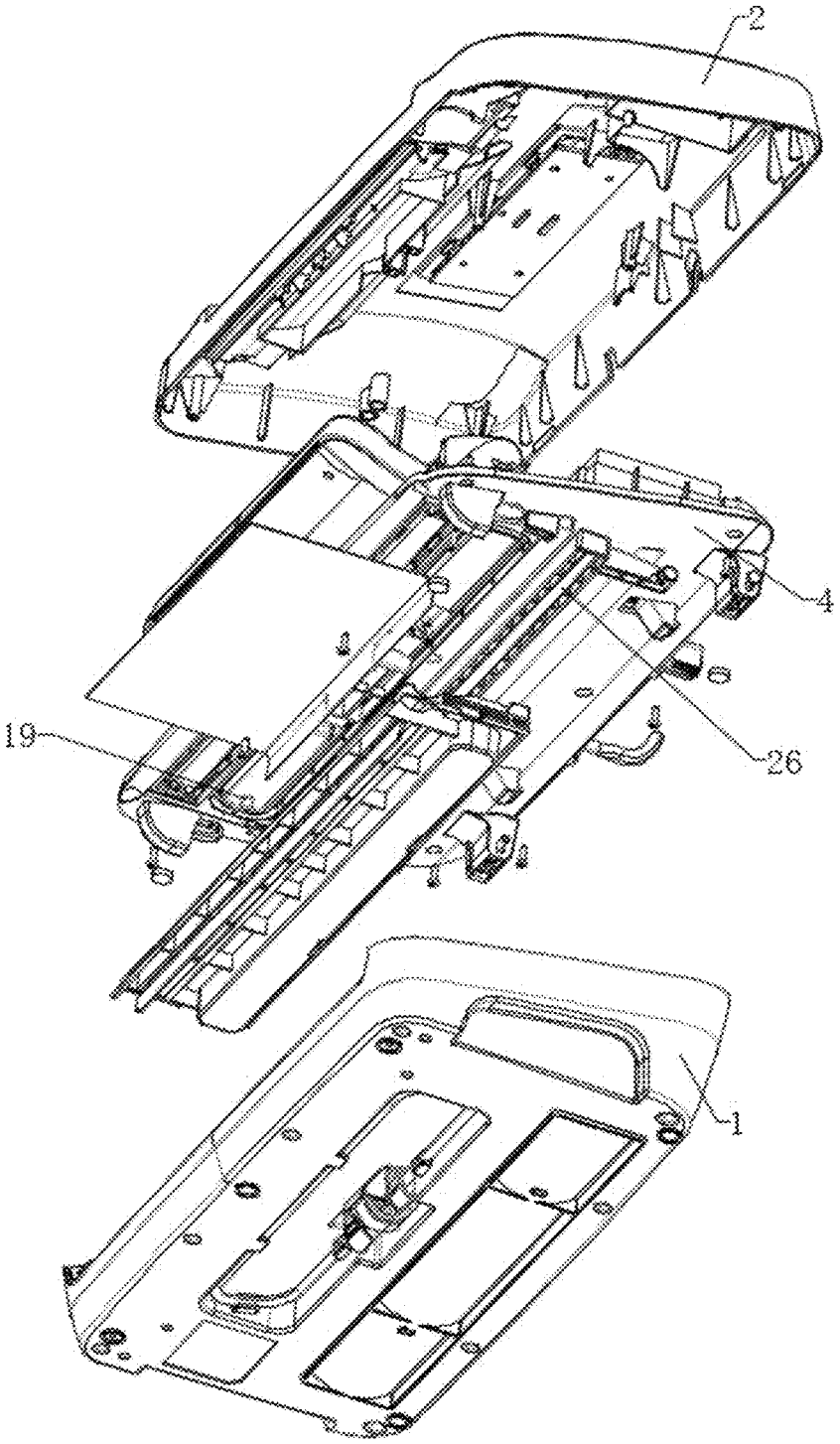
FIG. 4 is a schematic exploded structure diagram of the disclosure in another view.
Figure 5:
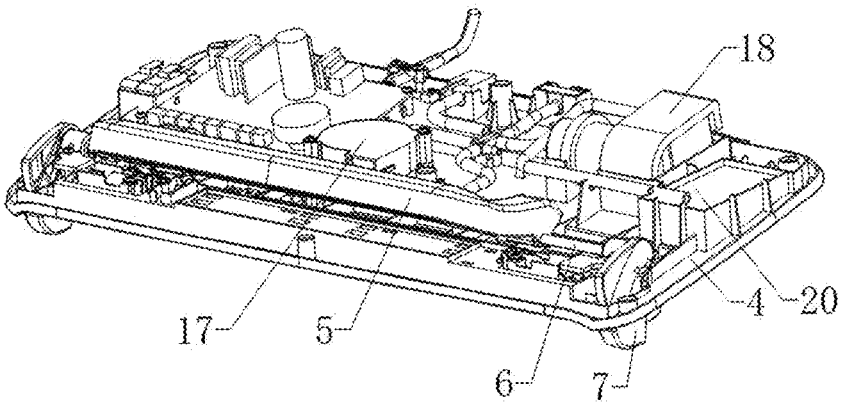
FIG. 5 is a schematic three-dimensional structure diagram of a device installing plate of the disclosure.
Figure 6:
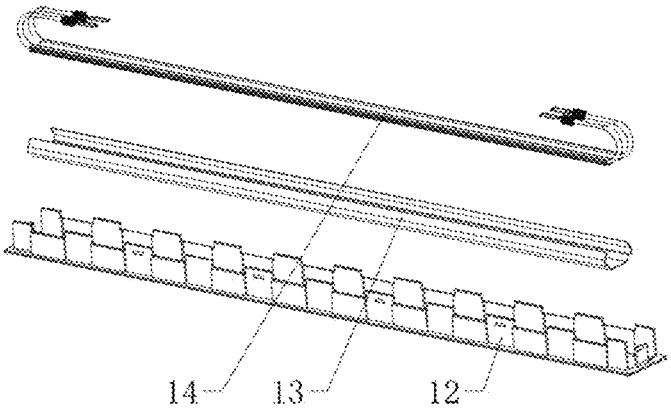
FIG. 6 is a schematic exploded structure diagram of a hot-melting sealing component of the disclosure.
Figure 7:
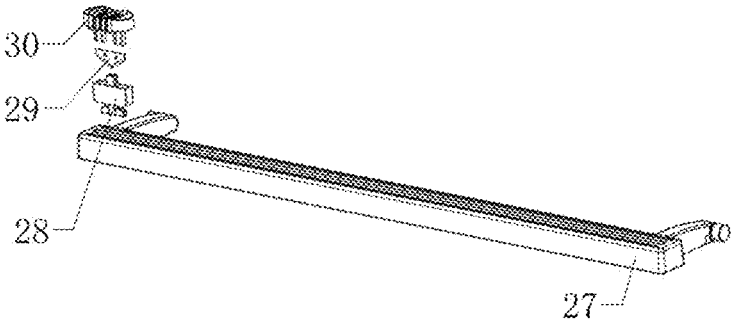
FIG. 7 is a schematic exploded structure diagram of a cutting component of the disclosure.
Figure 8:
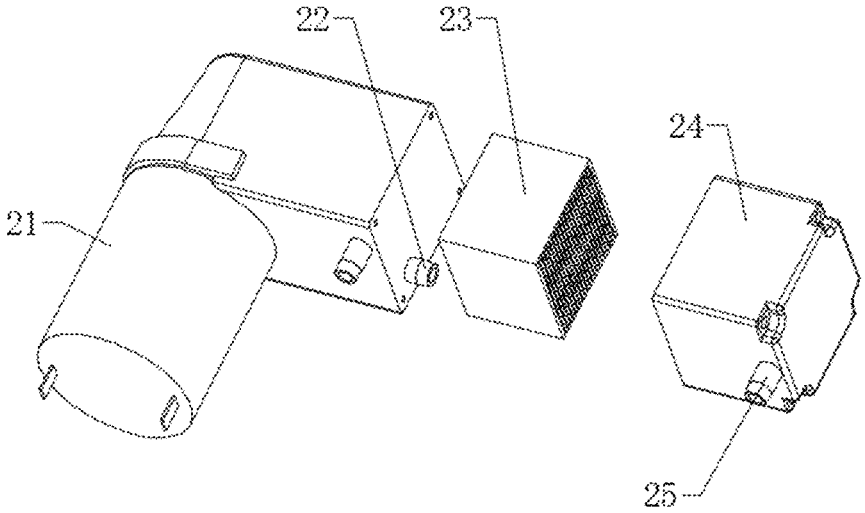
FIG. 8 is a schematic exploded structure diagram of a vacuum pump of the disclosure.
Figure 9:
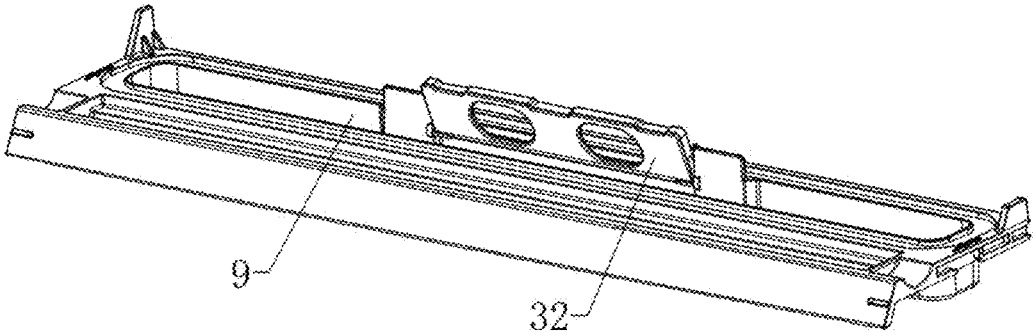
FIG. 9 is a schematic three-dimensional structure diagram of a vacuum cavity of the disclosure.
Figure 10:
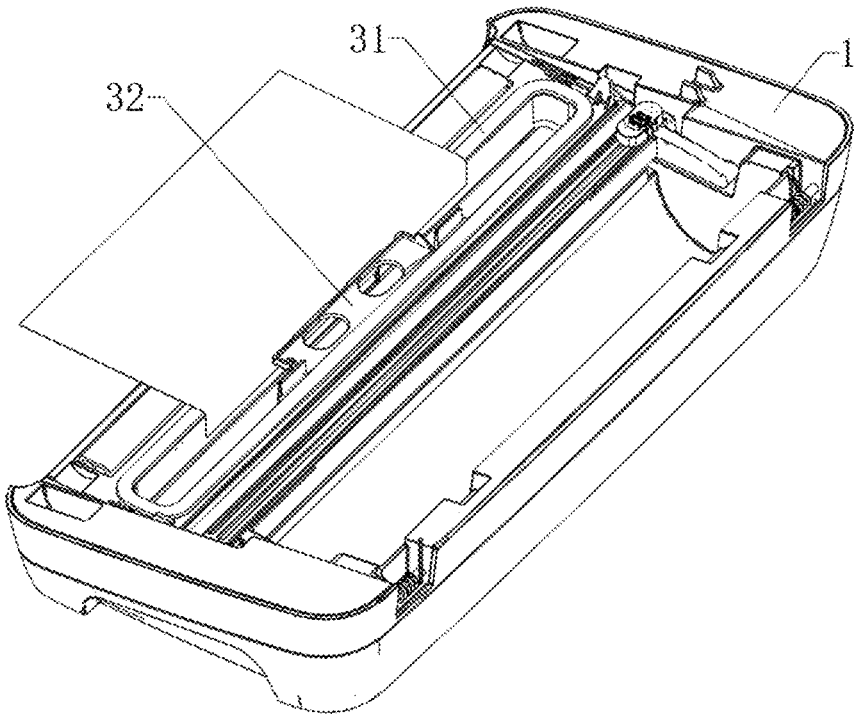
FIG. 10 is a schematic structure diagram of the disclosure after a bag opening clamping plate is turned over.

Referring to FIG. 1 to FIG. 10, the disclosure provides a vacuum package machine, which includes:

a lower housing 1;

an upper turning cover 2, rotationally disposed on the lower housing 1, where the lower housing 1 is internally provided with a vacuum cavity 9 configured to store water discharged from a package bag during vacuum pumping, and the vacuum cavity 9 is internally provided with a water level probe 19; and a clamping component 3, disposed between the lower housing 1 and the upper turning cover 2 and configured to tightly clamp a bag opening of the package bag and cooperate with the vacuum cavity 9 to form a sealed cavity for vacuum pumping.

The clamping component 3 includes a bag opening clamping plate 32. The bag opening clamping plate 32 is rotationally disposed in the vacuum cavity 9, and is configured to cooperate with an inner wall of the vacuum cavity 9 to tightly clamp the bag opening of the package bag.

During vacuum pumping on the package bag, a user places the bag opening of the package bag in the vacuum cavity 9, and flattens the bag opening of the package bags by two hands. Then, the flattened bag opening is pressed by one hand, and the bag opening clamping plate 32 is turned by the other hand, so the bag opening clamping plate 32 tightly clamps the bag opening of the package bag. At this moment, if the user releases the two hands, the bag opening of the package bag may not mess up.

Turning holes for turning are formed in the bag opening clamping plate 32, and the user may put fingers into the turning holes to conveniently do turning operation.

A hot-melting sealing component 11 is disposed on the upper turning cover 2, and is configured to melt the bag opening of the package bag, so that the bag opening position of the package bag is bonded and sealed.

A device installing plate 4 is disposed in the upper turning cover 2. A cooling component 16 for cooling the hot-melting sealing component 11 and a vacuum pump 18 are disposed on the device installing plate 4. An air pumping end of the vacuum pump 18 communicates with the vacuum cavity 9 through a first pipeline. A breathable acoustic material 23 is disposed inside the vacuum pump 18 and is configured to absorb noise during air exhausting.

A control panel is provided on a surface of the upper turning cover 2, and is configured to control all electric appliances of the vacuum package machine and receive information fed back in each link of the sealing and vacuum pumping operations of the vacuum package machine. The control panel belongs to the prior art, and is not repeated herein.

As an optional implementation, the clamping component 3 includes a rotating shaft 6 and a sealing strip 10. The rotating shaft 6 is rotationally disposed on the device installing plate 4 in a length direction of the device installing plate 4. A clamp hook 7 is fixed to each of two ends of the rotating shaft 6. Clamp grooves 8 are formed in the lower housing 1. The clamp hook 7 rotates with the rotating shaft 6 and is able to be clamped in the corresponding clamp groove 8. A handle 5 is disposed on the rotating shaft 6, and the handle 5 passes through the upper turning cover 2. The sealing strip 10 is disposed at an upper side of the vacuum cavity 9.

The rotating shaft 6 is rotated through the handle 5, and the two clamp hooks 7 are driven to rotate through the rotating shaft 6, so that the clamp hooks 7 are separated from the clamp grooves 8, that is, the upper turning cover 2 may be turned over. After the upper turning cover 2 is closed, the clamp hooks 7 are driven to rotate through the cooperation of the handle 5 and the rotating shaft 6, and the clamp hooks 7 are clamped into the clamp grooves 8, so that the upper turning cover 2 is limited. At this moment, a downward pulling force is provided for the upper turning cover 2, so that the clamping component 3 may tightly clamp the package bag.

An annular groove is formed in the upper side of the vacuum cavity 9, and a sealing ring 31 is disposed in the annular groove. The sealing strip 10 corresponds to a bottom of the hot-melting sealing component 11.

The water level probe 19 is installed on the device installing plate 4, and a probe of the water level probe 19 passes through the device installing plate 4 to enter the vacuum cavity 9.

The hot-melting sealing component 11 includes a heat conduction housing 12. The heat conduction housing 12 is disposed on the device installing plate 4. A high-temperature adhesive tape 13 is laid in the heat conduction housing 12, and an electric heating wire 14 is disposed on the high-temperature adhesive tape 13. The high-temperature adhesive tape 13 is configured to wrap the electric heating wire 14 to further improve the stability of the electric heating wire 14 inside the heat conduction housing 12. A bottom of the heat conduction housing 12 corresponds to the sealing strip 10. The electric heating wire 14 heats the heat conduction housing 12, the heat conduction housing 12 is in contact with the package bag to melt the package bag, and additionally, the bottom of the heat conduction housing 12 is a flat surface.

The cooling component 16 includes a blower 17. The blower 17 is disposed on the device installing plate 4. A blowing end of the blower 17 communicates with the heat conduction housing 12 through a ventilation pipe. A mica plate 15 is disposed on a top of the heat conduction housing 12, and through holes are formed in each of the mica plate 15 and the heat conduction housing 12. The blower 17 blows air into the heat conduction housing 12 through the ventilation pipe to realize air cooling. The mica plate 15 has good heat conductivity, so that the heat radiation efficiency on the hot-melting sealing component 11 is improved. The heat conduction housing 12 is made of aluminum alloy, which can further improve the heat conductivity.

A cutting component 26 is disposed in the lower housing 1, and is configured to cut away excessive portions after sealing of the package bag.

The cutting component 26 includes a cutter holder 27. The cutter holder 27 is disposed in the lower housing 1. A slide block 28 is slidingly disposed in the cutter holder 27. A cutter blade 29 is disposed on the slide block 28. A cutter cap 30 is disposed on the cutter blade 29.

During vacuum pumping, the excessive portions of the package bag are positioned above the cutter holder 27. After the vacuum pumping is completed, the upper turning cover 2 is turned over to expose the cutting component 26. At this moment, the cutting blade 29 is driven by the cutter cap 30 to move along the cutter holder 27 to cut away the excessive portions of the package bag.

The vacuum pump 18 includes a host 21. An acoustic shield 24 is installed on the host 21, and the breathable acoustic material 23 is disposed in the acoustic shield 24. A first air outlet hole 22 is formed in the host 21, and the acoustic shield 24 is able to cover the first air outlet hole 22. A second air outlet hole 25 is formed in the acoustic shield 24. Air sucked by the host 21 is exhausted into the acoustic shield 24 through the first air outlet hole 22. As the air flow flows at a high speed, the noise is loud. The noise may be significantly reduced through the breathable acoustic material 23. The second air outlet hole 25 is connected with a sponge block 20 through a second pipeline, and an end portion of the second pipeline is disposed in the sponge block 20. Through the arrangement of the sponge block 20, the air flow streams outwards exhausted by the vacuum pump 18 may be further scattered, so that the noise is reduced.

By using such a structure, the upper turning cover 2 is turned over, the package bag requiring vacuum pumping is disposed between the upper turning cover 2 and the lower housing 1, the bag opening of the package bag extends into the vacuum cavity 9, then, the upper turning cover 2 is closed, and the bag opening of the package bag is in the sealed cavity through the cooperation of the upper turning cover 2 with the clamping component 3 and the vacuum cavity 9. Then, through the vacuum pump 18, the air in the sealed cavity is completely exhausted until the air in the package bag is completely pumped out. In this process, if there is water in the package bag, the water will be pumped out and flow into the vacuum cavity 9. The water level probe 19 may give out a prompt when detecting the water fullness, so the contact of the water in the vacuum cavity 9 with electronic elements of the vacuum package machine due to continuous use of the vacuum package machine after water fullness is avoided.

When the vacuum pump 18 operates, the noise may be significantly absorbed through the sponge block 20 and the breathable acoustic material 23. After the vacuum pumping of the package bag is completed, the opening of the package bag is sealed through the hot-melting sealing component 11, and heat dissipation on the hot-melting sealing component 11 may be realized through the cooling component 16, so that the hot-melting sealing component may continuously operate.

The above is merely the specific implementations of the disclosure and is not intended to limit the scope of protection of the disclosure. Any variations or replacements apparent to a person skilled in the art within the technical scope disclosed by the disclosure shall fall within the scope of protection of the disclosure. Therefore, the scope of protection of the disclosure shall be subject to the scope of protection of the claims.

What is claimed is:

1. A vacuum package machine, comprising:

a lower housing (1);

an upper turning cover (2), rotationally disposed on the lower housing (1), wherein the lower housing (1) is internally provided with a vacuum cavity (9) configured to store water discharged from a package bag during vacuum pumping, and the vacuum cavity (9) is internally provided with a water level probe (19); and a clamping component (3), disposed between the lower housing (1) and the upper turning cover (2) and configured to tightly clamp a bag opening of the package bag and cooperate with the vacuum cavity (9) to form a sealed cavity for vacuum pumping;

wherein the clamping component (3) comprises a bag opening clamping plate (32), the bag opening clamping plate (32) is rotationally disposed in the vacuum cavity (9), and is configured to cooperate with an inner wall of the vacuum cavity (9) to tightly clamp the bag opening of the package bag;

a hot-melting sealing component (11) is disposed on the upper turning cover (2), and is configured to melt the bag opening of the package bag and bond the bag opening position of the package bag to realize sealing; and a device installing plate (4) is disposed in the upper turning cover (2), a cooling component (16) for cooling the hot-melting sealing component (11) and a vacuum pump (18) are disposed on the device installing plate (4), an air pumping end of the vacuum pump (18) communicates with the vacuum cavity (9) through a first pipeline, and a breathable acoustic material (23) is disposed inside the vacuum pump (18) and is configured to absorb noise during air exhausting.

2. The vacuum package machine according to claim 1, wherein the clamping component (3) comprises a rotating shaft (6) and a sealing strip (10), the rotating shaft (6) is rotationally disposed on the device installing plate (4) in a length direction of the device installing plate (4), a clamp hook (7) is fixed to each of two ends of the rotating shaft (6), clamp grooves (8) are formed in the lower housing (1), the clamp hook (7) rotates with the rotating shaft (6) and is able to be clamped in the corresponding clamp groove (8), a handle (5) is disposed on the rotating shaft (6), the handle (5) passes through the upper turning cover (2), and the sealing strip (10) is disposed at an upper side of the vacuum cavity (9).

3. The vacuum package machine according to claim 2, wherein an annular groove is formed in the upper side of the vacuum cavity (9), a sealing ring (31) is disposed in the annular groove, and the sealing strip (10) corresponds to a bottom of the hot-melting sealing component (11).

4. The vacuum package machine according to claim 3, wherein the hot-melting sealing component (11) comprises a heat conduction housing (12), the heat conduction housing (12) is disposed on the device installing plate (4), a high-temperature adhesive tape (13) is laid in the heat conduction housing (12), an electric heating wire (14) is disposed on the high-temperature adhesive tape (13), and a bottom of the heat conduction housing (12) corresponds to the sealing strip (10).

5. The vacuum package machine according to claim 4, wherein the cooling component (16) comprises a blower (17), the blower (17) is disposed on the device installing plate (4), a blowing end of the blower (17) communicates with the heat conduction housing (12) through a ventilation pipe, a mica plate (15) is disposed on a top of the heat conduction housing (12), and through holes are formed in each of the mica plate (15) and the heat conduction housing (12).

6. The vacuum package machine according to claim 1, wherein the water level probe (19) is installed on the device installing plate (4), and a probe of the water level probe (19) passes through the device installing plate (4) to enter the vacuum cavity (9).

7. The vacuum package machine according to claim 1, wherein a cutting component (26) is disposed in the lower housing (1), and is configured to cut away excessive portions after sealing of the package bag.

8. The vacuum package machine according to claim 7, wherein the cutting component (26) comprises a cutter holder (27), the cutter holder (27) is disposed in the lower housing (1), a slide block (28) is slidingly disposed in the cutter holder (27), a cutter blade (29) is disposed on the slide block (28), and a cutter cap (30) is disposed on the cutter blade (29).

9. The vacuum package machine according to claim 1, wherein the vacuum pump (18) comprises a host (21), an acoustic shield (24) is installed on the host (21), the breathable acoustic material (23) is disposed in the acoustic shield (24), a first air outlet hole (22) is formed in the host (21), the acoustic shield (24) is able to cover the first air outlet hole (22), a second air outlet hole (25) is formed in the acoustic shield (24), the second air outlet hole (25) is connected with a sponge block (20) through a second pipeline, and an end portion of the second pipeline is disposed in the sponge block (20).

* * * * *